United States Patent [19]

Burford et al.

[11] Patent Number: 4,856,258

[45] Date of Patent: Aug. 15, 1989

[54] WIRE TYING DEVICE

[75] Inventors: Charles E. Burford, Dallas, Tex.; Jimmy R. Frazier, Norman, Okla.

[73] Assignee: Burford Corp., Maysville, Okla.

[21] Appl. No.: 282,994

[22] Filed: Dec. 2, 1988

Related U.S. Application Data

[63] Continuation of Ser. No. 934,560, Nov. 21, 1986, abandoned.

[51] Int. Cl.[4] ..... B65B 7/06; B65B 51/08

[52] U.S. Cl. ..... 53/138 A; 53/583

[58] Field of Search ..... 53/138 A, 583; 198/740

[56] References Cited

U.S. PATENT DOCUMENTS

| | | | |
|---|---|---|---|
| 3,059,670 | 10/1962 | Burford et al. . | |
| 3,138,904 | 6/1964 | Burford . | |
| 3,202,087 | 8/1965 | Burford . | |
| 3,301,375 | 1/1967 | Schmermund | 198/740 |
| 3,740,921 | 6/1973 | Meyer | 53/138 A |
| 3,919,829 | 11/1975 | Burford et al. . | |
| 4,398,379 | 8/1983 | Burford . | |
| 4,534,149 | 8/1985 | Hoyland | 53/138 A |

*Primary Examiner*—John Sipos

*Attorney, Agent, or Firm*—Crutsinger & Booth

[57] ABSTRACT

A wire tying device for tying a wire-like ribbon about a neck of a bag moved along a path by a conveyor. The packaging device includes a bag gathering apparatus including a bag clamp plate positioned adjacent the path of the neck of the bag and a plunger which moves along the path to engage the neck of the bag between the clamping mechanism and a slotted face plate for pulling slack out of a plastic bag and to draw to the bag to a control tension about the product. An improved drive mechanism smoothly and rapidly accelerates a needle for wrapping a section of wire ribbon around the neck of the bag, a twister hook for twisting the wire, a wire holder-shear for gripping and cutting the wire ribbon and a striper arm for removing the twisted wire from the twister hook.

4 Claims, 7 Drawing Sheets

WIRE TYING DEVICE

This is a continuation of application Ser. No. 06/934,560 filed 11/21/86 now abandoned.

BACKGROUND OF INVENTION

The invention relates to apparatus for twisting a wire for closing and sealing the neck or open end of a flexible bag.

Apparatus of the type disclosed in U.S. Pat. No. 3,138,904 to Earl E. Burford entitled "METHOD AND APPARATUS FOR TYING PACKAGES AND WRAPPING MATERIALS"; U.S. Pat. No. 3,059,670 to Charles E. Burford and Leonard W. Burford entitled "WIRE TWISTING TOOL"; and U.S. Pat. No. 3,919,829 to Leonard W. Burford and Charles E. Burford entitled "APPARATUS FOR TYING PACKAGES AND WRAPPING MATERIALS" is used for closing a plastic bag by attaching and twisting a wire-like ribbon about the neck of the bag.

Apparatus of the type disclosed in U.S. Pat. No. 4,398,379 to Charles E. Burford entitled "TAB ATTACHMENT DEVICE" is also employed for closing plastic bags. However, such devices attach a deformable plastic clip about the neck of the bag for retaining it in a closed position.

SUMMARY OF INVENTION

The packaging apparatus described herein incorporates a bag gathering apparatus which includes a bag clamp, positioned along the path of the neck of a bag, and a plunger which moves along the path to engage the neck of the bag adjacent the bag. The plunger pulls slack out of the plastic bag, draws the bag to a controlled tension around the product in the bag, and gathers the neck of the bag. The free end of a ribbon of tie material is gripped by a holder-shear assembly such that the ribbon of tie material extends across the path of the gathered neck of the bag. A needle assembly wraps the ribbon of tie material about the gathered neck of the bag and positions the ribbon of tie material adjacent a twister hook. After the ribbon of tie material has been positioned around the neck of the bag and twisted, a stripper disengages the tie material from the twister hook and ejects the tied bag from the tying apparatus.

The apparatus incorporates an improved drive system which is particularly adapted for smooth rapid acceleration and deceleration permitting operation of the wire tying device at speeds sufficient for tying bags, for example, at a rate of 120 bags per minute. A pair of cams mounted on a plunger drive shaft actuate the bag clamp and the plunger assembly to provide synchronized movement for controlling the tension to which a bag is drawn around the contents of the bag.

A tying cycle is initiated by actuating a clutch which controls operation of the needle assembly, the holder-shear assembly, the twister hook assembly and the stripper assembly. The twister hook assembly is driven through a five position Geneva drive coupling to substantially eliminate high impact loading which sometimes accompanies rapid acceleration and deceleration of parts and assemblies of tying devices. The clutch is constructed to provide a sine wave profile of acceleration and deceleration to components of the system.

DESCRIPTION OF DRAWING

Drawings of a preferred embodiment of the invention are annexed hereto so that the invention may be better and more fully understood, in which.

Numeral references are employed to designate parts illustrated in the drawing and like numerals designate like parts throughout the various figures of the drawing.

DESCRIPTION OF A PREFERRED EMBODIMENT

Figure 1:
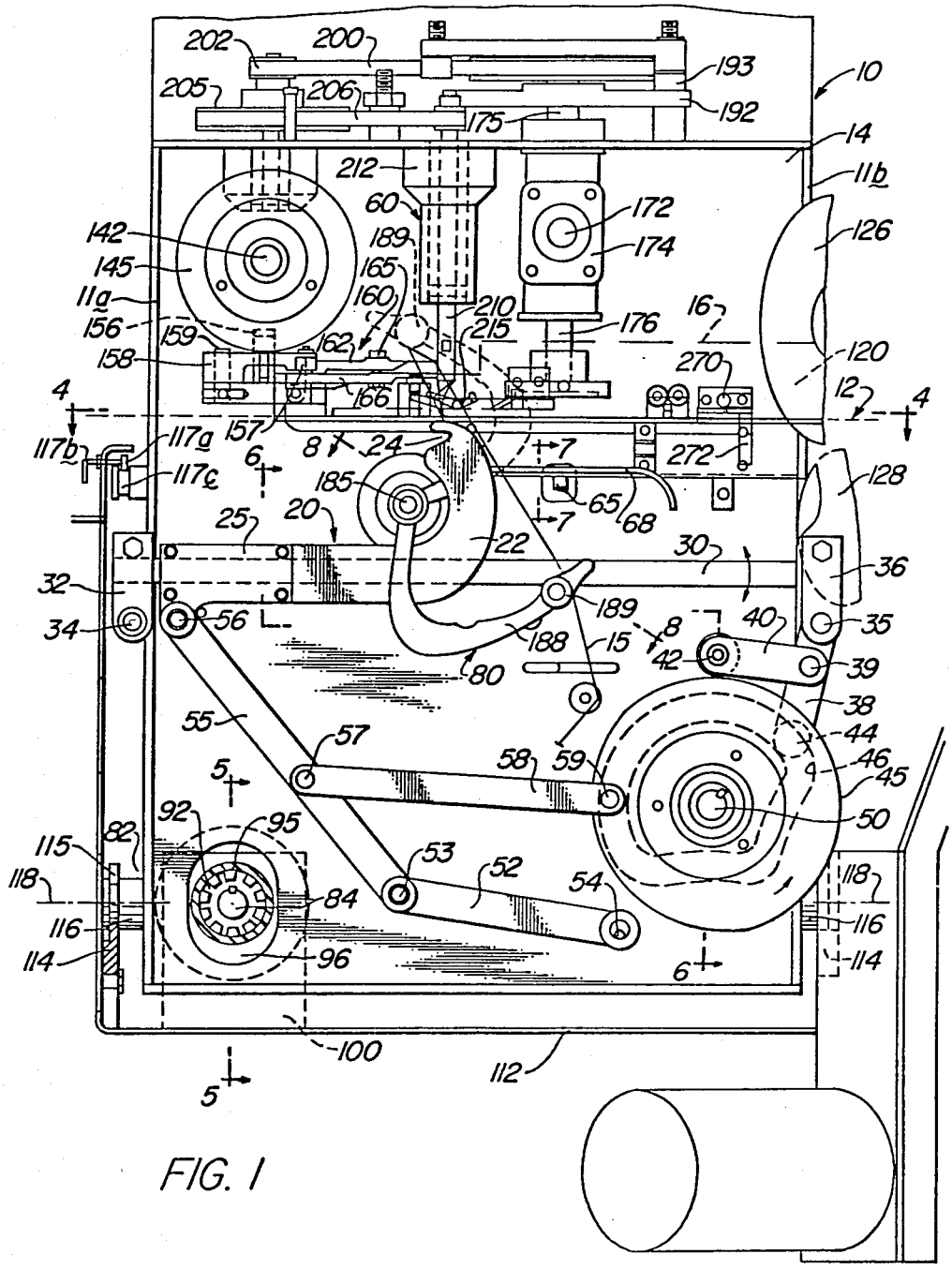
FIG. 1 is a front elevational view of the wire tying device.
Figure 2:
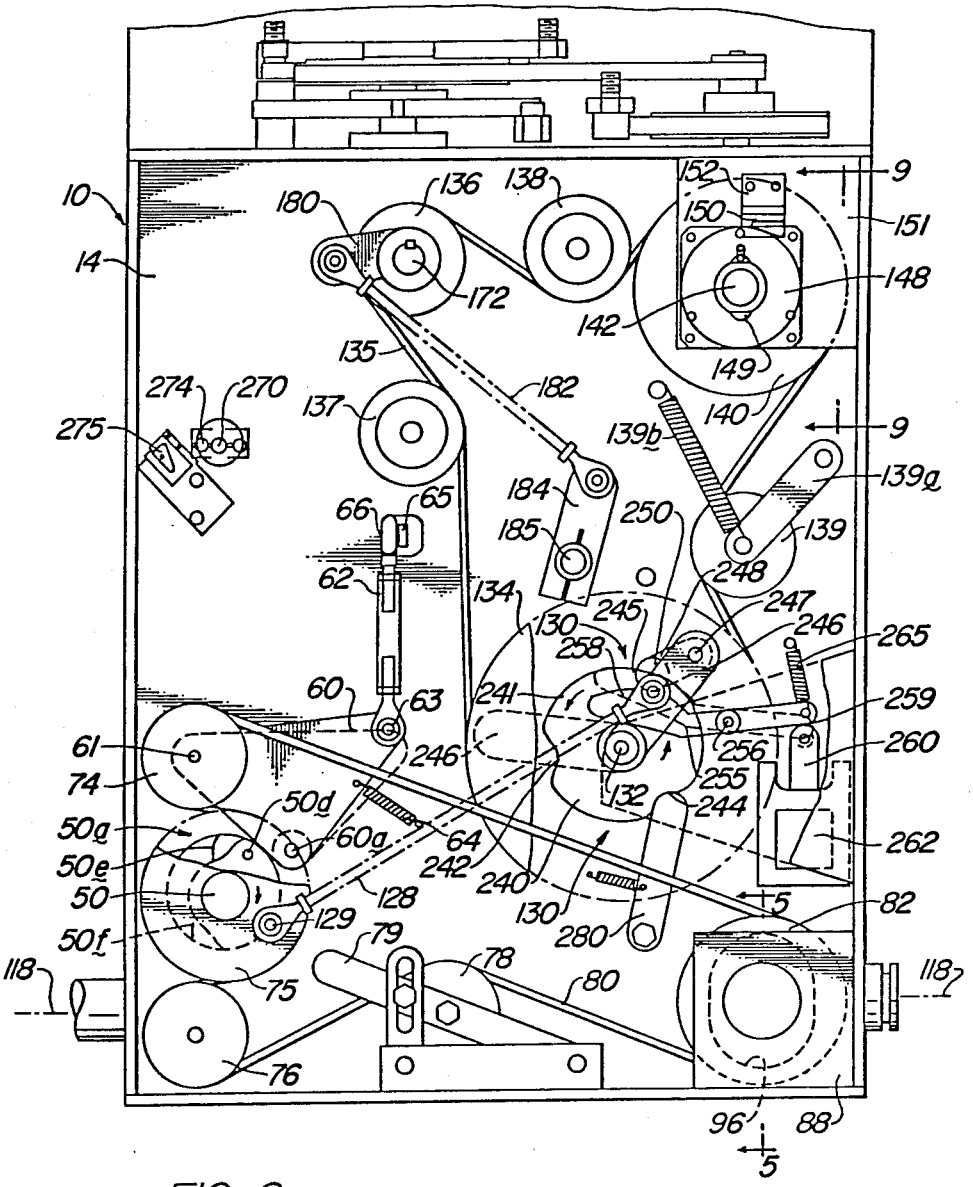
FIG. 2 is a rear elevational view thereof.

The wire tying device generally designated by the numeral 10 in FIGS. 1 and 2 of the drawing is mounted adjacent a conveyor 300 of the type disclosed in Burford U.S. Pat. No. 3,138,904 and Burford U.S. Pat. No. 3,919,829, the disclosures of which are incorporated herein by reference in their entirety for all purposes. As will be hereinafter more fully explained, a conveyor belt 300 carries for example, loaves 125 of bread to, through and out of wire tying device 10 in rapid succession. Such conveyor 300 is well known to persons skilled in the art and further description thereof is not deemed necessary except in connection with the drive mechanism as will be hereinafter more fully explained.

Referring to FIG. 1 of the drawing, the numeral 20 generally designates a bag gathering apparatus for moving a bag 125 along a path 12 to a position adjacent a holder-shear assembly 160, twister hook assembly 60 and needle assembly 80. As will be hereinafter more fully explained, the free end of a ribbon of wire-like material 15 is gripped in holder-shear assembly 160. Plunger assembly 20 moves the neck 124 of the bag through a slot 122 in face plate 16 for drawing the bag 125 to a controlled tension about the contents thereof. Needle assembly 80 wraps the ribbon 15 of the wire-like material about the gathered neck of the bag and twister hook 60 is actuated for twisting a portion of the wire-like material about the neck 124 of the bag 125.

BAG GATHERING APPARATUS

Referring to FIGS. 1, 2, 6 and 7, bag gathering apparatus 20 comprises a bag plunger 22 having a generally V-shaped notch 24 formed on the end thereof for engaging the neck 124 of the bag 125 as will be hereinafter more fully explained. Plunger 22 is carried on a slide block 25 which reciprocates along plunger guide bar 30.

As best illustrated in FIG. 1 of the drawing, one end of plunger guide bar 30 is pivotally secured by an arm 32 and pin 34 to the frame or housing 11 of wire tying device 10.

The opposite end of plunger guide bar 30 is secured to an arm 36 which is pivotally secured by a pin 35 to a link 38 which is in turn pivotally secured by pin 39, crank arm 40 and pin 42 to the support wall 14 of the housing of wire tying device 10.

A plunger actuating cam 45 has a plunger cam groove or track 46 formed therein into which a follower 44 on the end of link 38 is movably disposed. Cam 45 is pinned or otherwise secured to a shaft 50 which extends through an aperture in wall 14 and is rotatably secured in ball bearings in housing 48.

As best illustrated in FIG. 1 of the drawing, one end of crank arm 52 is pivotally secured by a pin 54 to wall 14 and the other end is pivotally secured by a pin 53 to an end of link 55. Link 55 is secured by a pin 56 to the slide block 25 which moves bag plunger head 22 along guide bar 30. Opposite ends of arm 58 are pivotally secured to a central portion of link 55 by pin 57 and to cam disc 45 by pin 59.

From the foregoing, it should be readily apparent that as cam 45 rotates in a counter-clockwise direction as viewed in FIG. 1 of the drawing, pin 59 and arm 58 will move down and to the right as viewed in FIG. 1, thereby rotating link 55 to move slide block 25 from a position adjacent support arm 32 to a position wherein plunger 22 is adjacent support arm 36 at the opposite end of guide bar 30.

From the position of pin 59 as illustrated in FIG. 1 of the drawing, rotation of cam 45 through an angle of approximately 180° moves slide block 25 and plunger head 22 toward arm 36. Simultaneously, rotation of cam 45 imparts movement to cam follower 44 on the end of link 38 which initially pulls link 38 and arm 36 downwardly for rotating guide bar 30 about pin 34 such that plunger head 22 moves downwardly away from path 12 as movement of slide 25 toward arm 36 is initiated from the position illustrated in FIG. 1. As slide block 25 moves along a central portion of guide bar 30, cam groove 46 is shaped for causing plunger head 22 to be moved toward path 12 as plunger head 22 approaches path 12 adjacent arm 36. Continued rotation of cam 45 maintains guide bar 30 in a substantially horizontal position as slide block 25 and plunger head 22 move along path 12 from a position adjacent arm 36 back to the position illustrated in FIG. 1.

From the foregoing it should be readily apparent that plunger head 22 reciprocates longitudinally along guide bar 30 while arm 36 on the end of guide bar 30 imparts a reciprocating motion for pivoting guide bar 30 and slide block 25 carried thereon about support pin 34.

Figure 7:
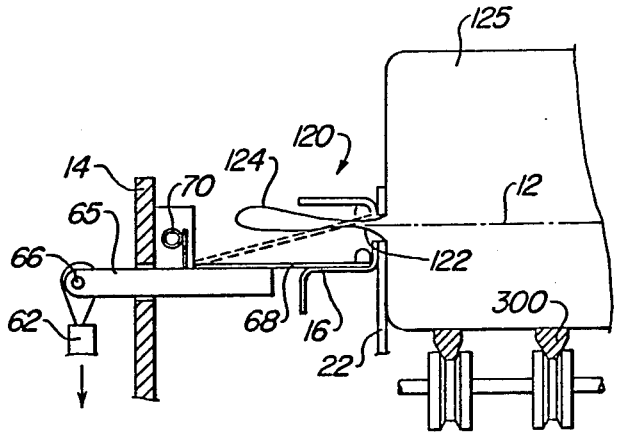
FIG. 7 is a cross-sectional view taken along line 7—7 of FIG. 1.
Figure 6:
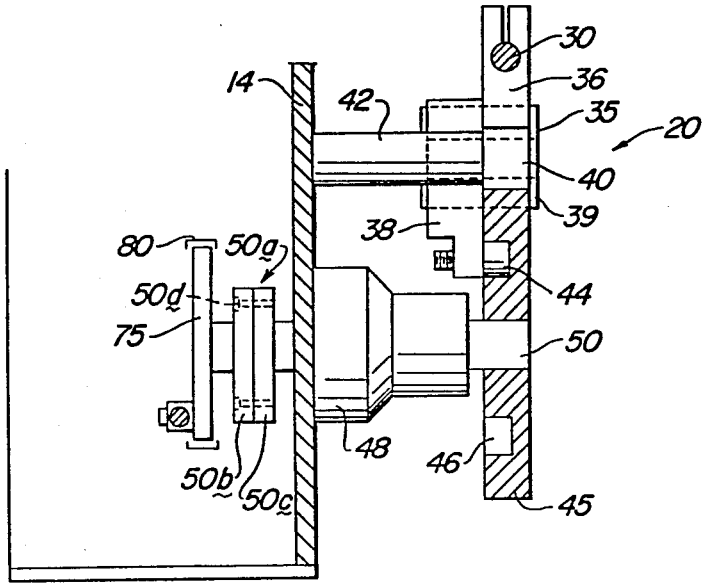
FIG. 6 is a cross-sectional view taken along line 6—6 of FIG. 1.

Referring to FIGS. 2, 6 and 7 of the drawing, shaft 50 extends through wall 14 and has a clamp cam 50*a* mounted thereon. Cam 50*a* is a segmented cam having a first segment 50*b* and a second segment 50*c* secured together by bolts 50*d*. Cam segments 50*b* and 50*c* are of substantially identical construction each having an outwardly extending lobe and a reduced portion. However, cam segment 5*c* is keyed or otherwise secured to shaft 50 for rotating therewith. Cam segment 50*b* is rotatable around shaft 50 relative to cam segment 50*c* such that the leading edge 50*e* of the lobe of the cam is adjustable relative to the trailing edge 50*f* of the lobe of the cam for adjusting the length of the lobe as will be hereinafter more fully explained.

As best illustrated in FIG. 2 of the drawing, a cam follower 60*a* is rotatably secured to a bag clamp actuating arm 60 and rides on the surface of cam segments 50*b* and 50*c* for imparting longitudinal reciprocating motion to actuating link 62 which is pivotally secured to bag clamp arm 65. Actuating arm 60 is pivotally secured to rotate relative to a shaft 61 on which idler sprocket 74 is rotatably secured. Link 62 is pivotally secured to actuating arm 60 by a pin 63 and the opposite end of link 62 is pivotally secured to bag clamp arm 65 by a pin 66. A spring 64 resiliently urges cam follower 60*a* on actuating arm 60 into engagement with cam segments 50*b* and 50*c*.

As best illustrated in FIG. 7 of the drawing, a pressure foot 68 is secured to clamp arm 65 which is pivotally secured by a pin 70 to wall 14.

From the foregoing it should be readily apparent that rotation of shaft 50 and cam 50*a* imparts reciprocating motion through actuating arm 60 to link 62 for rotating pressure foot 68 between the position illustrated in full outline in FIG. 7 and the position illustrated in dashed outline.

As best illustrated in FIGS. 2 and 6 of the drawing, shaft 50 has a sprocket 75 mounted on the end thereof and is driven by a gathering chain 80 which extends around idler sprockets 74, 76 and 78 and is driven by a drive sprocket 82. As illustrated in FIG. 2, idler sprocket 78 is rotatably secured to an arm 79 which is pivotally secured to the frame of tying device 10 to permit adjustment of the tension in gathering chain 80.

Figure 5:
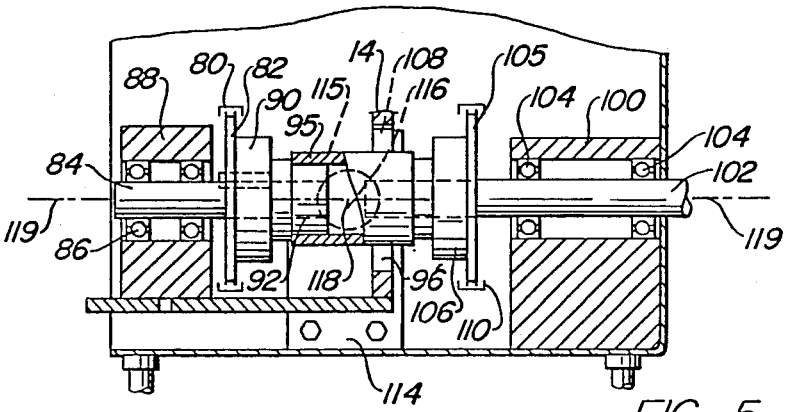
FIG. 5 is a cross-sectional view taken along line 5—5 of FIGS. 1 and 2.

As best illustrated in FIG. 5 of the drawing, drive sprocket 82 is mounted on a shaft 84 which is rotatably mounted in bearings 86 in a bearing block 88. A coupling 90 is secured to shaft 84 and has spline teeth 92 formed on the outer surface thereof. A resilient coupling 95 has internal spline teeth formed therein mating with spline teeth 92 on coupling 90 to provide a resilient torque transmitting power input source to shaft 84 and gathering chain 80.

As best illustrated in FIGS. 1, 2, and 5, deformable coupling 95 extends through an elongated opening 96 in wall 14 of tying device 10.

Bearing block 100 is secured to the frame of a conveyor (not shown) and rotatably supports shaft 102 in bearings 104. A sprocket 105 and coupling 106 are mounted on shaft 102, coupling 106 being provided with spline teeth 108 which extend into flexible coupling 95 and engage internal spline teeth formed therein. Chain 110 extends around sprocket 105 and is driven by the conveyor drive means (not shown).

As best illustrated in FIGS. 1 and 5, bearing block 100 is mounted on a support frame 112 which is supported by the frame of the powered conveyor 300 or adjacent a side thereof. Support frame 112 is provided with a pair of brackets 114 having slotted U-shaped openings 115 formed therein to provide a cradle into which pivot pins 116, secured to opposite side walls 11*a* and 11*b* of the frame of tying device 10, extend.

Pivot pins 116 are received in openings 115 and are rotatable about an axis 118 which extends generally parallel to a side of the conveyor (not shown) and which intersects and is perpendicular to an axis 119 about which drive shafts 84 and 102 and resilient coupling 95 rotate. A latch arm 117*a* is pivotally secured to support frame 112 and is rotatable by a latch lever 117*b* to engage or disengage a latch pin 117*c* which is secured to the side wall 11*a* of tying device 10.

From the foregoing it should be readily apparent that the frame of the tying device may be pivoted about axis 118 by disengaging latch 117*a* from pin 117*c*. When the frame of the tying device is rocked back about axis 118 relative to the conveyor, the front of the tying device is accessible for maintenance and to facilitate routing the wire ribbon 15 through the needle assembly to the holder-shear mechanism. It should be readily apparent that since the axes 118 and 119 intersect, deformable internally splined coupling 95 permits shaft 84 to move slightly out of alignment with shaft 102 while maintaining deformable coupling 95 in engagement with spline teeth 116 and 108 on couplings 90 and 106.

From the foregoing it should be readily apparent that chain 110 drives coupling 106 through sprocket 105 which applies a driving torque to resilient coupling 95 for driving coupling 90, sprocket 82 and gathering chain 80. As illustrated in FIG. 2, gathering chain 80 imparts rotation to shaft 50 through sprocket 75. Cams 50*a* and 45 are driven by shaft 50 for reciprocating the pressure foot 68 of bag clamp 120 while reciprocating plunger head 22 and plunger guide bar 30 in synchronized relation with movement of the conveyor 300. Thus, bag clamp 120 and plunger head 22 are continuously driven in synchronized relation with the conveyor and are timed to move through a cycle of operation upon passage of each flight of the conveyor past the tying device 10. Upon movement of each flight of the conveyor past tying device 10, one package will be moved past tying device 10 if the conveyor is fully loaded and has packages carried thereon at the maximum capacity of the conveyor 300.

As best illustrated in FIGS. 1 and 7 of the drawing, the horizontal plane of path 12 along which the neck 124 of bag 125 moves extends through slot 122 formed in face plate 16 secured to the frame of tying device 10.

A pair of brushes 126 and 128 rotate to engage the neck 124 of the bag 125 to position the neck 124 in the slot 122 in face plate 16 as the bag is moved along path 12 by a conveyor 300. As the flight of the conveyor 300 carrying bag 125 moves adjacent tying device 10 pressure foot 68 moves upwardly from the position illustrated in full outline in FIG. 7 of the drawing to the position illustrated in dashed outline to frictionally engage the neck of the bag as plunger head 22 moves along plunger guide bar 30 from a position adjacent arm 36 toward arm 32. Plunger head 22 engages the neck 124 of the bag which is restrained by pressure foot 68 to thereby draw the slack packaging material to a controlled tension around the contents of the bag and to form a gathered neck adjacent the strand of wire-like ribbon 15 and adjacent twister hook assembly 60.

TYING MECHANISM

Referring to FIG. 2 of the drawing, a connecting rod 128 is pivotally secured between sprocket 75 and a clutch generally designated by the numeral 130. As will be hereinafter more fully explained, when clutch 130 is energized a twisting cycle is initiated.

Clutch 130 is mounted on a stub shaft 132 having a sprocket 134 mounted thereon for imparting motion to an actuating chain 135 which rotates sprockets 136 and 140. Actuating chain 135 extends around idler sprockets 137 and 138 and chain tensioning idler sprocket 139. Chain tensioning idler sprocket 139 is mounted on an arm 139*a* pivotally secured to wall 14 and spring 139*b* maintains tension in chain 135.

Figure 9:
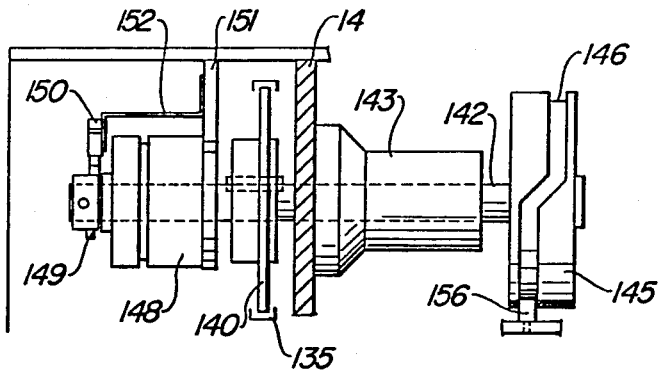
FIG. 9 is a cross-sectional view taken along line 9—9 of FIG. 2.

As best illustrated in FIGS. 2 and 9 of the drawing, sprocket 140 is mounted on a shaft 142 which is rotatably journaled in roller bearings mounted in bearing housing 143. A shuttle cam 145 having a cam groove 146 formed therein is mounted on one end of shaft 142. An electric brake 148 and cam 149 are mounted on the opposite end of shaft 142. Cam 149 is positioned to actuate a microswitch 150. Electric brake 148 and cam 149 are supported on a hanger 151 and bracket 152.

Figure 4:
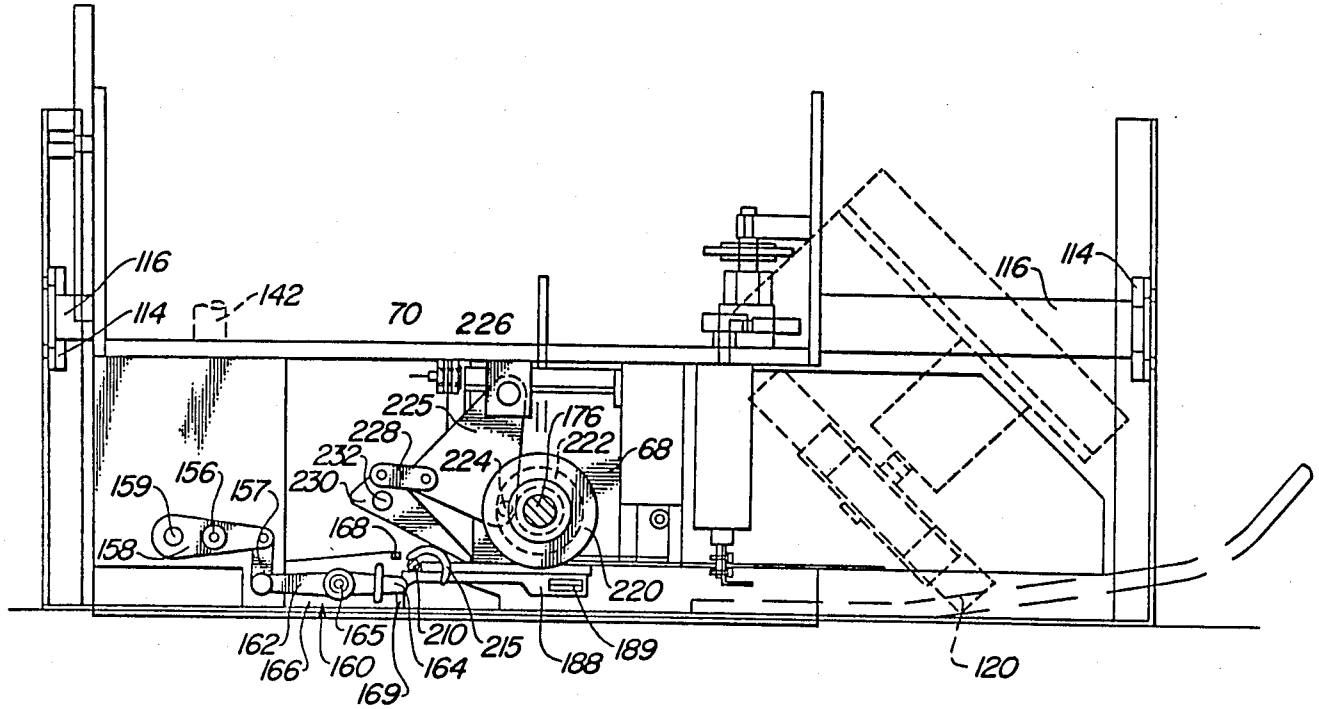
FIG. 4 is a cross-sectional view taken substantially along line 4—4 of FIG. 1, parts being broken away to more clearly illustrate details of construction.

A cam follower 156 extends into cam groove 146 in cam wheel 145 and, as best illustrated in FIG. 4 of the drawing, is mounted on an actuating arm 158 secured by a pin 159 to the frame of the tying device. The opposite end of arm 159 is pivotally secured to a link 157 pivotally secured to the holder-shear assembly 160. Holder-shear assembly 160 comprises a gripper arm 162 having a gripper finger 164 on one end thereof rotatably secured to a mounting plate 166 by a bolt 165. A pair of anvils 168 and 169 are formed on the end of mounting plate 166, each being associated with shear surfaces to grip and cut a strand 15 of wire-like ribbon as will be hereinafter more fully explained.

Cam groove 146 is formed to move follower 156 between a first position wherein gripper finger 164 is positioned adjacent anvil 168 and a second position adjacent anvil 169. In the illustrated embodiment the gripper arm and mounting plate 166 are symmetrical about a centerline such that the holder-shear assembly 160 may be used on a right hand or left hand machine.

Referring to FIG. 2 of the drawing, sprocket 136 is mounted on the end of a shaft 172 which extends through support wall 14 into a gear box 174, illustrated in FIG. 1, having output shafts 175 and 176 secured thereto for providing the input to a Geneva coupling 190 for driving the twister hook 215 and for rotating a cam 220 for actuating the stripper 230.

Figure 8:
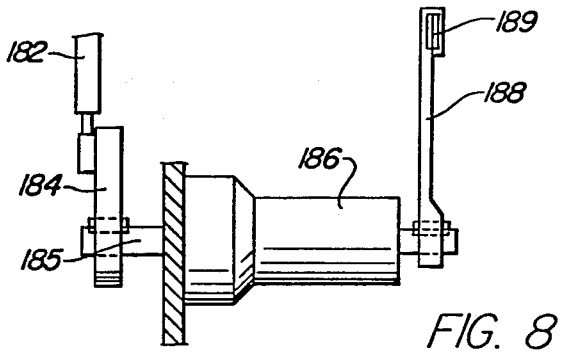
FIG. 8 is a cross-sectional view taken along line 8—8 of FIG. 1.

As illustrated in FIG. 2 of the drawing, a needle actuating arm 180 is secured to shaft 172 and is pivotally secured to an adjustable needle link 182 which is pivotally secured to a crank arm 184 secured to a shaft 185. As best illustrated in FIG. 8 of the drawing, shaft 185 is supported in roller bearings mounted in bearing housing 186 and has a curved needle 188 mounted on the outer end thereof. Needle 188 carries a roller 189 on the outer end thereof and is actuated from the position shown in full outlines in FIG. 1 of the drawing to the position illustrated in dashed outline and then back to the position shown in full outline upon rotation of shaft 172 through one complete revolution.

Figure 3:
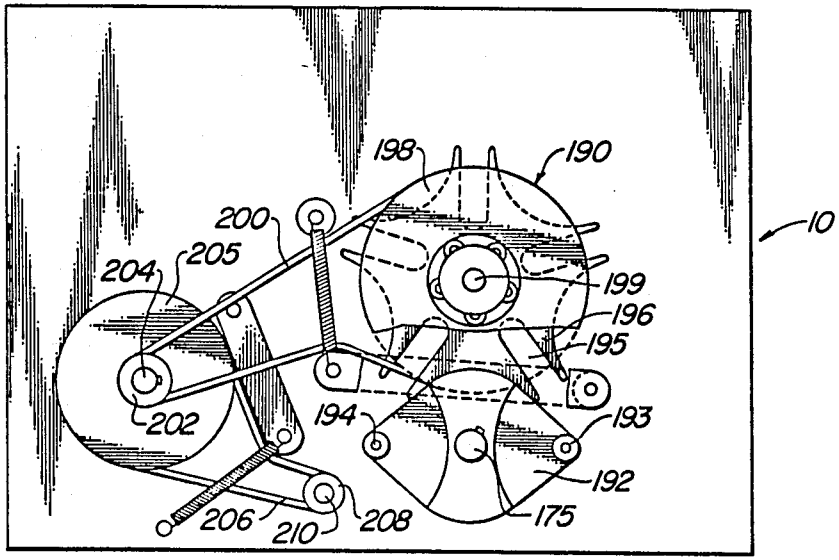
FIG. 3 is a to plan view.

Referring to FIGS. 1 and 3 of the drawing, the upwardly extending shaft 175 from gear box 174 serves as the input for a five position Geneva coupling 190. Geneva coupling 190 incorporates a drive member 192 secured to shaft 175 and carrying a pair of drive pins 193 and 194 which extend into guideways 195 in star wheel 196. Star wheel 196 is drivingly secured to a sprocket 198 for imparting movement to a chain 200. Star wheel 196 and sprocket 198 are rotatably mounted on a stub shaft 199 secured to the frame of tying device 10. Chain 200 drives a sprocket 202 secured to a shaft 204 which in turn drives a sprocket 205. Shaft 204 is rotatably secured to the frame of the housing of the tying device. Sprocket 205 drives a chain 206 which extends about a sprocket 208 secured to the upper end of shaft 210 of the twister assembly.

Shaft 210 is rotatably secured in ball bearings in bearing housing 212 and has a twister hook 215 secured to the lower end thereof. Twister hook 215 is similar to the twister tools disclosed in Burford U.S. Pat. No. 3,059,670 and Burford U.S. Pat. No. 3,919,829.

Referring to FIGS. 1 and 4 of the drawing, the downwardly extending shaft 176 from gear box 174 has a cam wheel 220 mounted on the lower end thereof. Cam wheel 220 has a cam groove 222 formed therein into which a follower 224 on a crank 225 extends. Crank 225 is pivotally secured to rotate about end 226 for actuating a stripper arm 230 through a link 228. Opposite ends of link 228 are pivotally secured to arm 225 and stripper 230. Stripper 230 is rotatably secured by a pin 232 to the frame of the tying device.

The clutch generally designated by the numeral 130 includes a cam 240 having a plurality of notches 242, 244 and 245 formed in the outer periphery thereof. One end of clutch link 246 is pivotally secured to shaft 132 and the other end of pivotally secured to clutch arm 248 by a pin 247. Cam follower 280 is pivotally secured to clutch arm 248 and is positioned to engage the periphery of cam plate 240. One end of actuating link 128 is pivotally secured to clutch arm 246 and the opposite end is pivotally secured to sprocket 75. It should be readily apparent that sprocket 75 functions as a crank for imparting reciprocating motion to link 128 as sprocket 75 rotates about the axis of shaft 50. Reciprocating longitudinal movement of link 128 causes clutch arm 126 to oscillate between the position illustrated in full outline in FIG. 2 of the drawing and the position illustrated in dashed outline.

In the illustrated embodiment clutch arm 246 oscillates through an angle of 120° upon rotation of sprocket 75 through 360° from the position illustrated in full outline in FIG. 2 of the drawing to the position illustrated in dashed outline and then returns to the full outline position. In the illustrated embodiment, cam plate 240 has three notches 242, 244 and 245 circumferentially spaced 120° about the periphery thereof.

It should be appreciated that clutch arm 248 is configured to position follower 250 to one side of a center line of clutch arm 246 extending through shaft 132 and pin 247 such that cam plate 240 will be rotated only in a counterclockwise direction, as viewed in FIG. 2 of the drawing, upon actuation of crank arm 248 through a complete cycle of operation. Otherwise stated, clutch 130 is a one way clutch transmitting torque in one direction but not transferring torque in the opposition direction.

A bridge arm 255 is pivotally secured by a pin 256 to support wall 14 of tying device 10 and has a curved surface 258 on the end thereof which is congruent to the outer periphery of cam plate 240. The opposite end of bridge arm 255 is connected through a link 259 to a rod 260 actuated by a solenoid 262. A spring 265 resiliently urges bridge arm 255 toward the position illustrated in full outline in FIG. 2 of the drawing. When solenoid 262 is actuated rod, 260 is retracted thereby pivoting bridge arm 255 about pin 256 for moving the curved surface 258 thereon into alignment with the curved surface 241 on the outer periphery of cam plate 240 to bridge across notch 242, 244 or 245 which may be positioned adjacent cam follower 250. Thus, cam follower 250 cannot drop into a notch in cam plate 240 while solenoid 262 is energized.

As best illustrated in FIG. 1 of the drawing, a shaft 270 extends through support wall 14 and has a trigger arm 272 secured to the end thereof and extending transversely across the path 12 along which the neck 124 of bag 125 is moved. Thus, movement of a bag neck along path 12 rotates arm 272 and shaft 270 upon arrival of the bag to initiate a cycle of operation. As illustrated in FIG. 2 of the drawing, a lever 274 on shaft 270 is positioned to actuate trigger switch 275 upon movement of arm 272 by a bag moving along path 12. Switch 275 is electrically connected to deenergize magnetic brake 148 and solenoid 262 when a bag arrives in position and rotates arm 272. When solenoid 262 is deactuated, spring 265 moves bridge arm 255 to the position illustrated in full outline in FIG. 2 of the drawing allowing cam follower 250 to drop into notch 245 in cam 240. Rotation of sprocket 75 imparts rotation to cam 240, rotating the cam through an angle of 120°.

In the illustrated embodiment, sprocket 134 is provided with fifty-four teeth. Sprocket 136 has eighteen teeth and sprocket 140 has thirty-six teeth. Thus, rotation of sprocket 134 through an angle of rotation of 120° causes sprocket 136 to rotate through 360° and causes sprocket 140 to rotate one-half revolution or 180°.

Rotation of sprocket 136 through one revolution causes shaft 182 to oscillate moving the needle 188 through one complete cycle of operation from the position illustrated in full outline in FIG. 1 of the drawing to the position illustrated in dashed outline and then back to the position illustrated in full outline.

Rotation of sprocket 140 through one-half revolution rotates shuttle cam 145 through one-half revolution thereby moving gripper finger 162 relative to mounting plate 166 from a position adjacent anvil 168 to a position adjacent anvil 169.

Rotation of sprocket 136 through one complete revolution also rotates the downwardly extending output shaft 176 from gear box 174 through one complete revolution thereby moving stripper cam 220 through one complete revolution to move stripper 230 from the position illustrated in FIG. 4 in a clockwise direction as viewed in FIG. 4 past stripper hook 215 and back to the position illustrated in FIG. 4 for disengaging a twisted wire 15 from twister hook 215.

Rotation of sprocket 136 through one revolution rotates the upwardly extending output shaft 175 from gear box 174 through one revolution causing the five position Geneva coupling 190 to drive twister hook shaft 210 through four complete revolutions for twisting the wire.

Approximately two-thirds of the way through the tying cycle, cam 149 on shaft 142 actuates microswitch 150 to energize magnetic brake 148 and to energize solenoid 262.

When magnetic brake 148 is energized a braking force is applied to shaft 142, sprocket 140 and actuating chain 135 thus applying a braking action to all moving parts of the tying apparatus except for the gathering mechanism 20 which is driven continuously and is isolated from the braking action of magnetic brake 148 through the one way clutch 130.

When solenoid 262 is energized by microswitch 150 bridge arm 255 is pivoted in a clockwise direction about pin 256 as illustrated in FIG. 2 of the drawing thereby moving the curved surface 258 on bridge arm 255 into alignment with the outer periphery 241 of cam 240 thereby preventing rotation of cam 240 by cam follower 250 until solenoid 262 is again de-energized by actuation of switch 275 upon arrival of another bag.

An arm 280 is urged in a counterclockwise direction as illustrated in FIG. 2 of the drawing such that the end thereof engages one of the notches 242, 244 or 245 in cam plate 240 to indicate that clutch plate 242 is properly positioned for initiating a tying cycle when switch 275 is actuated.

Figure 10:
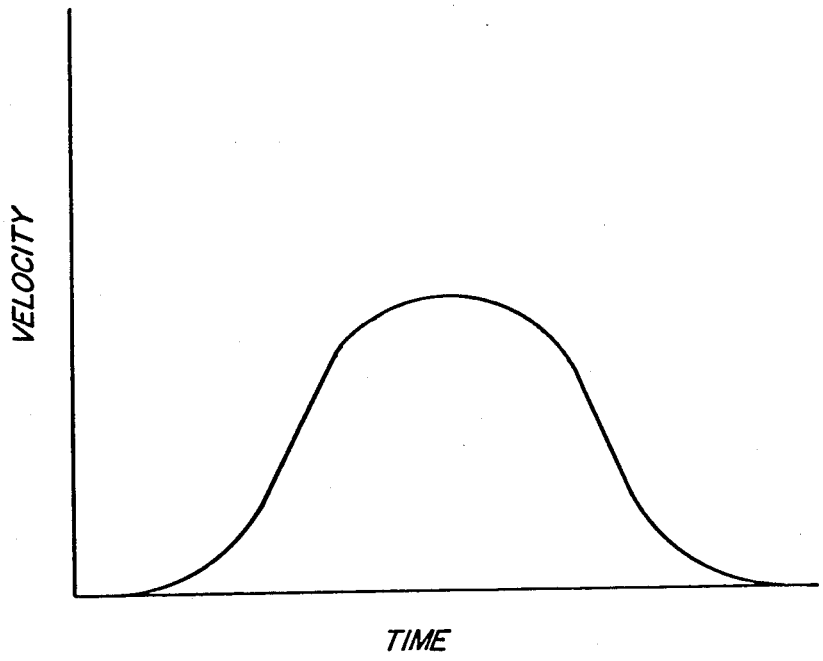
FIG. 10 is a diagram illustrating the velocity changes of parts of the apparatus during acceleration and deceleration.

From the foregoing it should be readily apparent that the improved drive apparatus illustrated in FIG. 2 of the drawing, initiates a tying cycle while pin 129 securing pull rod 128 to sprocket 75 is moving in a substantially vertical direction and causes cam plate 240 to be accelerated at a rate as diagrammatically illustrated in FIG. 10 of the drawing wherein the velocity changes in accordance with a pure sinusoidal curve to a maximum velocity and then the parts are smoothly de-accelerated as cam follower 245 is disengaged from notch 245 and electric brake 148 is energized. Electric brake 148 applies sufficient force to overcome the inertia of the moving parts bringing them to a home position ready for the next tying cycle.

Shock loading of the system is substantially eliminated as a result of the improved drive system hereinbefore described.

The adjustable cam 50*a* comprising cam segments 50*b* and 50*c* which are adjustable relative to each other permits adjustment of the bag clamp 120 to provide precise control of the tension to which a bag is drawn around the contents thereof for tying.

Having described my invention, I claim:

1. Apparatus to position a bag along a path comprising: a frame; a plunger; plunger guide means; first cam actuated means secured to said plunger to reciprocate said plunger linearly on said plunger guide means; means pivotally securing said plunger guide means to said frame; and second cam actuated means secured to said guide means to pivot said guide means to position said plunger adjacent said path such that said plunger engages the neck of a bag moving along said path and moves along said path as it moves in a first linear direction on said guide means, wherein said plunger moves away from said path to disengage the neck of the bag as said plunger begins to move in the opposite linear direction along said guide means; bag clamp means positioned adjacent said path; and means for actuating said clamp means perpendicularly to said path to restrict movement of the neck of a bag longitudinally of said path as said plunger moves adjacent to said clamp means to adjust tension in the bag.

2. Apparatus to position a bag along a path comprising: a frame; a plunger head; a rigid guide bar; means movably securing said plunger head to said guide bar; means pivotally securing a first end of said guide bar to said frame; a shaft rotatably secured to said frame; drive means associated with said shaft to rotate said shaft; first linkage means pivotally secured to a second end of said guide bar; cam means on a first end of said shaft to operate said first linkage means to reciprocate said second end of said guide bar about said pivot means toward and away from said path upon rotation of said shaft; second linkage means secured to said plunger head; means mounted on said shaft and pivotally secured to said second linkage means to reciprocate said plunger head longitudinally of said guide bar upon rotation of said shaft; a plurality of cam segments secured to a second end of said shaft; bag clamp means movably secured to said frame; and actuating means connected between said bag clamp means and said cam segments for actuating said bag clamp means upon rotation of said shaft.

3. Apparatus to position a bag along a path comprising: a frame; a plunger; plunger guide means; means to reciprocate said plunger linearly on said plunger guide means; means pivotally securing said plunger guide means to said frame; cam actuated means secured to said guide means to pivot said guide means to position said plunger adjacent said path such that said plunger moves along said path as it moves in a first linear direction on said guide means, and wherein said plunger moves away from said path as it begins to move in the opposite linear direction along said guide means; a shaft having first and second ends; said means to reciprocate said plunger and said means to move said guide means being secured to said first end of said shaft such that said plunger and said guide means move in a predetermined relationship; bag clamp means positioned adjacent said path; and means secured to said second end of said shaft for actuating said clamp means to restrict movement of the neck of a bag longitudinally of said path as said plunger moves adjacent to said clamp means to adjust tension in said bag.

4. Apparatus according to claim 3, said means to actuate said clamp means being mounted on said shaft such that movement of said clamp means, said plunger, and said plunger guide means are maintained in a predetermined relationship.

* * * * *

UNITED STATES PATENT AND TRADEMARK OFFICE

CERTIFICATE OF CORRECTION

PATENT NO. : 4,856,258

DATED : August 15, 1989

INVENTOR(S) : Charles E. Burford and Jimmy R. Frazier

It is certified that error appears in the above-identified patent and that said Letters Patent is hereby corrected as shown below:

Col. 2, line 9, change "to" to --top--.

Signed and Sealed this

Nineteenth Day of June, 1990

*Attest:*

HARRY F. MANBECK, JR.

*Attesting Officer*

*Commissioner of Patents and Trademarks*